US007863548B2

(12) United States Patent
Kim

(10) Patent No.: US 7,863,548 B2
(45) Date of Patent: Jan. 4, 2011

(54) METHOD FOR PREVENTING OVERHEATING OF MICROWAVE OVEN

(75) Inventor: Seung Hoe Kim, Paju-si (KR)

(73) Assignee: Daewoo Electronics Corporation, Seoul (KR)

( * ) Notice: Subject to any disclaimer, the term of this patent is extended or adjusted under 35 U.S.C. 154(b) by 1055 days.

(21) Appl. No.: 11/638,476

(22) Filed: Dec. 14, 2006

(65) Prior Publication Data

US 2007/0138170 A1 Jun. 21, 2007

Related U.S. Application Data

(63) Continuation-in-part of application No. 11/362,349, filed on Feb. 27, 2006, now Pat. No. 7,420,145.

(30) Foreign Application Priority Data

Dec. 20, 2005 (KR) ..... 10-2005-0126023

(51) Int. Cl.
*H05B 6/68* (2006.01)
*H05B 6/66* (2006.01)

(52) U.S. Cl. ..... 219/716; 219/719; 219/702

(58) Field of Classification Search ..... 219/715–719, 219/702, 704, 710, 680, 685, 739, 756, 762, 219/763

See application file for complete search history.

(56) References Cited

U.S. PATENT DOCUMENTS

| | | | | |
|---|---|---|---|---|
| 6,064,048 | A * | 5/2000 | Lim | 219/716 |
| 6,593,556 | B1 * | 7/2003 | Kim | 219/702 |
| 2003/0218009 | A1 * | 11/2003 | Lee | 219/721 |
| 2005/0077290 | A1 * | 4/2005 | Lee et al. | 219/685 |

* cited by examiner

*Primary Examiner*—Tu B Hoang
*Assistant Examiner*—Hung Nguyen
(74) *Attorney, Agent, or Firm*—The Nath Law Group; Jerald L. Meyer; Jiaxiao Zhang

(57) ABSTRACT

A method for preventing overheating of a microwave oven includes receiving information of a cooking condition and a cooking start command for current cooking, the cooking condition including a magnetron output level and a current cooking period, confirming pause duration from when preceding cooking was finished to when the current cooking is started, if it is determined that the magnetron output level is a preset magnetron output level or more, and determining a basic output period and a reference period for changing the magnetron output level corresponding to the confirmed pause duration, followed by operating the microwave oven at the preset magnetron output level after changing the magnetron output level to the preset magnetron output level, if it is determined that a driving period for changing the magnetron output level has passed the determined reference period.

12 Claims, 4 Drawing Sheets

METHOD FOR PREVENTING OVERHEATING OF MICROWAVE OVEN

CROSS-REFERENCE TO RELATED APPLICATION

This application is a continuation-in-part application of U.S. patent application Ser. No. 11/362,349 filed on Feb. 27, 2006 now U.S. Pat. No. 7,420,145, which is based on Korean Patent Application No. 10-2005-0126023 filed on Dec. 20, 2005.

BACKGROUND OF THE INVENTION

1. Field of the Invention

The present invention relates to a method for preventing overheating of a microwave oven.

2. Description of the Related Art

A microwave oven is a kitchen appliance based on a principle that food generates heat via molecular motion of the food itself by passing microwave radiation at a frequency of about 2,450 MHz through the food within a metallic case.

In the microwave oven, when microwave radiation at the frequency of about 2,450 MHz is oscillated from a magnetron and passes through the food in a cooking chamber, molecules constituting the food are charged to have a positive charge and a negative charge arranged at opposite sides thereof by the microwave radiation. At this time, the molecules have the positive charge at one side near a negative polarity of electric field created by the microwave beam, and the negative charge at the other side near a positive polarity of the electric field.

In this regard, the polarity of electric field is changed two thousand four hundred and fifty million times per second, and causes severe collisions between the molecules, so that the food is cooked by heat created by the collision of the molecules in the food.

FIG. 1 is a constructional view illustrating a conventional microwave oven.

Referring to FIG. 1, the conventional microwave oven comprises a power terminal through which commercial alternating current power is supplied, a fan motor 50 connected with the power terminal to drive a cooling fan used for cooling various electric components, a tray motor 60 connected in parallel with the fan motor 50 to rotate a tray of a cooling chamber, a high voltage transformer 70 connected with the power terminal to supply high voltage to a magnetron.

In addition, a fuse 80 and a door switch 90 are connected in series between the power terminal and the fan motor 50 in which the door switch 90 is switched on and off corresponding to opening and closing of a door of the microwave oven. A sub relay 30 is connected between the power terminal and the fan motor 50, and a main relay 40 is connected between the fan motor 50 and a primary coil of the high voltage transformer 70.

The microwave oven further comprises a controller 20 which outputs a control signal in order to control the main relay 40 and the sub relay 30 to be switched on/off in response to a key signal input from a key input part 10. The sub relay 30 is switched on/off in response to the control signal from the controller 20, and serves to supply or cut off the commercial AC power through the power terminal to or from the fan motor 50, the tray motor 60, and the high voltage transformer 70. The main relay 40 is switched on or off according to the control signal from the controller 20, and serves to supply or cut off the commercial AC power supplied through the power terminal to or from the high voltage transformer 70.

In the conventional microwave oven, when the magnetron is continuously operated for a long period of time by supplying power to the high voltage transformer 70, various electric components of the microwave oven including the high voltage transformer 70 are liable to be overheated, and thus it is necessary to control an output level in relation to a cooking period of time.

However, the conventional microwave oven has a problem in that, since the output level is determined depending on the cooking period, the electric components can be damaged due to overheating of the microwave oven which can occur when an internal temperature of the microwave oven before or after cooking is not considered in the case where the microwave oven is continuously operated without a pause or with intervals of short pauses.

SUMMARY OF THE INVENTION

The present invention has been made to solve the above problems, and it is an object of the present invention to provide a method for preventing overheating of a microwave oven, by which an output level of a magnetron can be automatically controlled corresponding to an operating time and pause duration of the microwave oven, thereby preventing the microwave oven from being overheated.

In accordance with one aspect of the present invention, the above and other objects can be accomplished by the provision of a method for preventing overheating of a microwave oven including a controller for controlling a magnetron output level, comprising the steps of: (a) receiving information of a cooking condition and a cooking start command for current cooking, the cooking condition comprising a magnetron output level and a current cooking period; (b) confirming pause duration from when preceding cooking was finished to when the current cooking is started, if it is determined that the magnetron output level is a preset magnetron output level; and (c) determining a basic output period and a reference period for changing the magnetron output level corresponding to the confirmed pause duration, followed by operating the microwave oven at the preset magnetron output level after changing the magnetron output level to the preset magnetron output level, if it is determined that a driving period for changing the magnetron output level has passed the determined reference period for changing the magnetron output level.

In accordance with other aspect of the present invention, the above and other objects can be accomplished by the provision of a method for preventing overheating of a microwave oven including a controller for controlling a magnetron output level, comprising the steps of: (a) receiving information of a cooking condition and a cooking start command for current cooking, the cooking condition comprising a magnetron output level and a current cooking period; (b) confirming pause duration from when preceding cooking was finished to when the current cooking is started, if it is determined that the magnetron output level is a preset magnetron output level or more; (c) increasing a counter value for changing the magnetron output level if the pause duration is a preset period or less, and initializing the counter value for changing the magnetron output level if the pause duration exceeds the preset period; and (d) operating the microwave oven at the preset magnetron output level after changing the magnetron output level to the preset magnetron output level if the counter value for changing the magnetron output level is a preset value or more, and determining a basic output period and a reference period for changing the magnetron output level corresponding to the confirmed pause duration if the counter value for changing the magnetron output level is less than the preset value, followed by operating the microwave oven at the preset magnetron output level after changing the magnetron output level to the preset magnetron output level if it is determined that a driving period for changing the magnetron output level has passed the determined reference period for changing the magnetron output level.

BRIEF DESCRIPTION OF THE DRAWINGS

The foregoing and other objects and features of the present invention will be more clearly understood from the following detailed description taken in conjunction with the accompanying drawings, in which.

DESCRIPTION OF THE PREFERRED EMBODIMENTS

Figure 1:
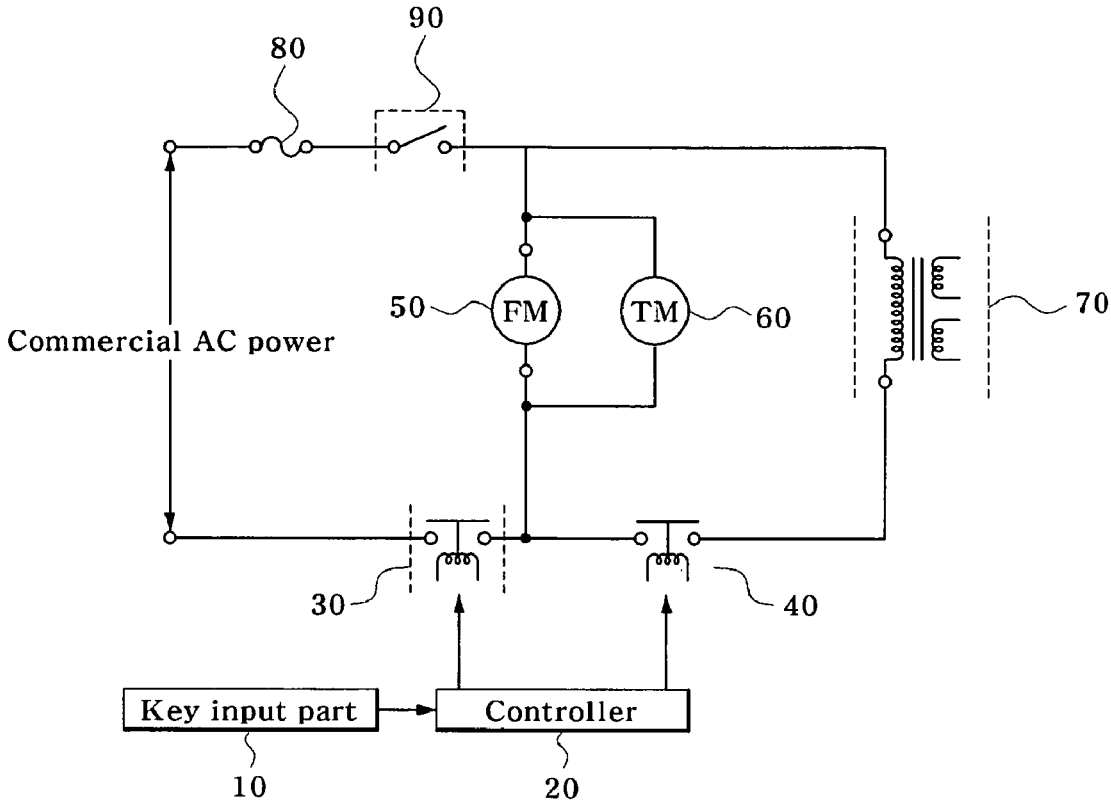
Fig. 1 Prior Art
FIG. 1 is a circuit diagram of a conventional microwave oven.

Preferred embodiments of the present invention will be described in detail with reference to the accompanying drawings along with description of terms and reference characters.

T: Current cooking period set by a user.

td: Duration during which a microwave oven has not been operated prior to current cooking. That is, it means pause duration from when preceding cooking was finished to when the current cooking is started.

Specifically, the pause duration comprises an elapsed time from a time of stopping the microwave oven caused by opening a door or by pushing any one of buttons for temporary pause, stop and cancel of command during operation thereof as well as a time of finishing the preceding cooking to a time of pushing a button for starting the current cooking.

T1: Preceding cooking period. Specifically, it means a period of operation for the microwave oven during which the microwave oven has been operated for all preceding cooking operations prior to the current cooking.

In this regard, if the pause duration td is 5 minutes or less, T1 means a cooking period obtained by summing all previous separate cooking periods before and after this pause duration of 5 minutes or less. For example, if the microwave oven is operated in the sequence of cooking of 10 minutes+pause of 25 minutes or less+current cooking, T1 required for changing a magnetron output level for the current cooking is 10 minutes. On the other hand, if the microwave oven is operated in the sequence of cooking of 10 minutes+pause of 2 minutes+cooking of 10 minutes+pause of 2 minutes+current cooking, T1 required for changing the output level for the current cooking is 20 minutes which is obtained by summing 10 minutes and 10 minutes.

T2: Driving period for changing the output level. Specifically, it means a period of time for changing the output level during cooking, and is set to T2=T1+t2+weight value.

The weight value is determined dependent on T1 and td, and is provided as 0, 5 or 10 minutes.

t2: Elapsed time of the current cooking.

A: Basic output period. Specifically, it means a period of time to force the microwave oven to be operated at an output level set by the user for a predetermined period of time prior to any other conditions in relation to change of the output level at an initial stage of cooking.

That is, when the microwave oven starts the cooking operation, it is operated at the output level set by the user for A minutes so long as an output level changing event is not generated.

In this embodiment of the present invention, A is provided as a value selected from 0, 5, and 13 minutes according to the range of td.

Z: Counter value for changing the output level. It means a value increasing one by one under a condition that the pause duration "td" between a preceding cooking operation and a subsequent cooking operation is 25 minutes or less. For example, when Z is 4 or more, it means that the preceding cooking operations are continuously performed 4 or more times, followed by the current cooking within the pause duration of 25 minutes or less. In this case, even though the microwave oven is set by the user to operate at, for example, 80% or more of a full output level, the microwave oven is forced to operate at 70% of the full output level for initial A minutes corresponding to the pause duration instead of 80% or more of the full output level.

Initializing operating condition: Condition wherein the pause duration "td" between the preceding cooking and the current cooking exceeds 25 minutes. In this condition, Z is converted to 1.

A process of preventing overheating of a microwave oven according to the embodiment of the present invention will be described with reference to FIGS. 2*a* to 2*c* as follows.

Figure 2A:
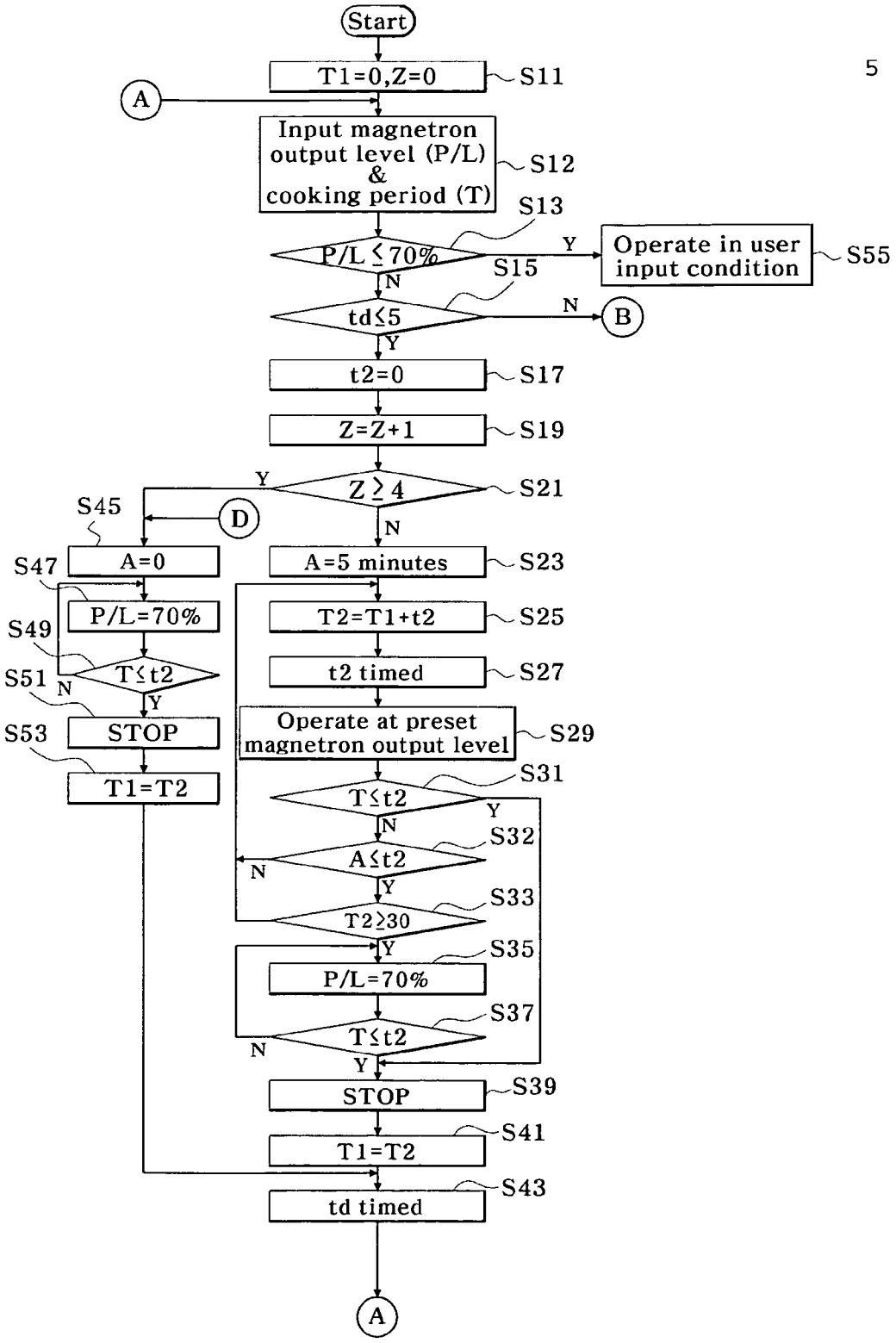
FIGS. 2*a* to 2*c* are flow charts illustrating a process of preventing overheating of a microwave oven according to one embodiment of the present invention.
Figure 2B:
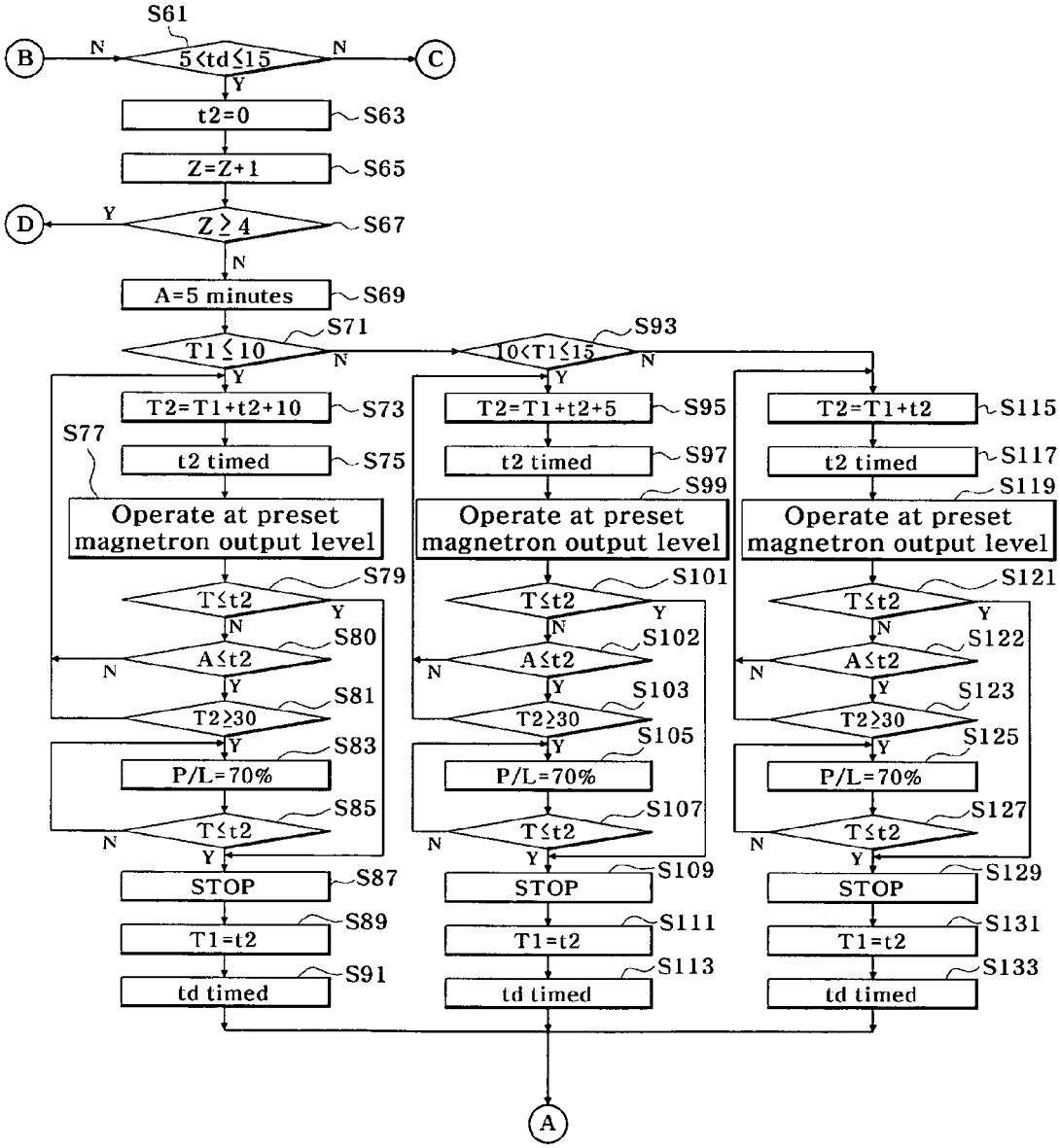
Figure 2C:
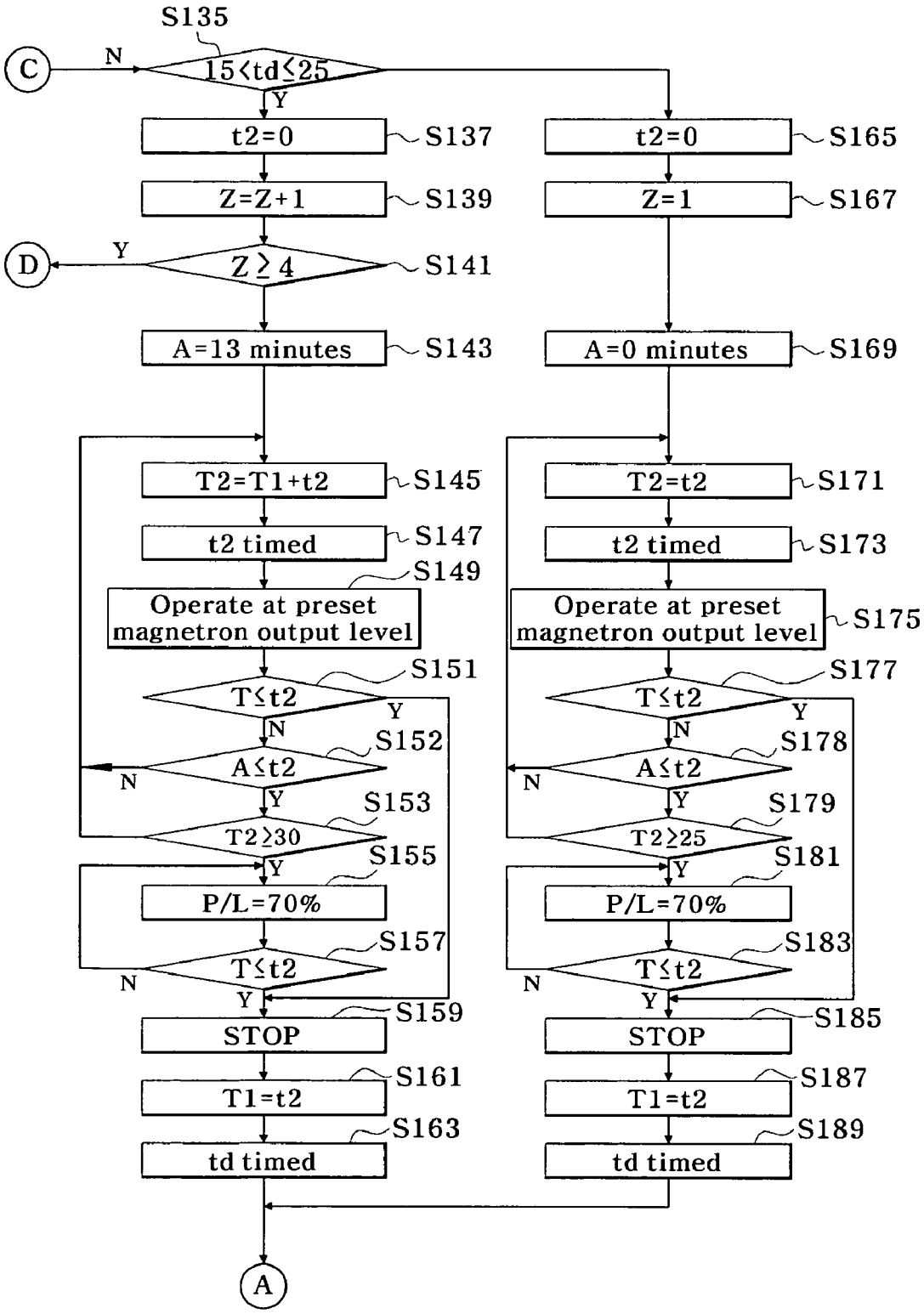

Referring to FIGS. 2*a* to 2*c*, in the process according to the embodiment of the present invention, first, a preceding cooking period T1 and a counter value Z for changing a magnetron output level are initialized at step S11 of FIG. 2*a*. Then, at step S12, a cooking period T and a magnetron output level P/L for cooking a predetermined food are set and a start command for cooking is input. At step S13, it is determined whether or not the output level P/L is 70% or less.

As a result of determination at step S13, if the output level is 70% or less, the microwave oven operates in response to a user input condition, whereas, if the output level exceeds 70%, it is determined at step S15 whether or not td is 5 or less.

As a result of determination at step S15, if td is greater than 5, the process progresses to step S61 of FIG. 2*b* to determine whether or not td is in the range of $5<td\leqq 15$. On the other hand, if it is determined that td is 5 or less, an elapsed time t2 of the current cooking is initialized to 0 at step S17, and Z is set to Z+1 at step S19.

Next, at step S21, it is determined whether or not Z is 4 or more. If Z is 4 or more, a basic output period A is set to 0 at step S45. If Z is less than 4, the microwave oven starts a cooking operation after setting A to 5, which is a value determined according to the pause duration td, at step S23.

Then, at step S25, a driving period T2 for changing the output level is set to T1+t2, and at step S27, t2 is timed. Next, from steps S29 to S32, the microwave oven is operated at a preset output level set by the user for A minutes.

Here, at step S31, the microwave oven is operated at the preset output level for A minutes, and if it is determined that the elapsed time t2 of the current cooking has passed the current cooking period T set by the user, the process progresses to step S39 to stop the operation. At step S33, it is determined whether or not the driving period T2 for changing the output level is 30 minutes or more, which is a reference period for changing the magnetron output level determined dependant on the pause duration td.

As a result of determination at step S33, if T2 is less than 30 minutes, the process returns to step S27, whereas, if T2 is 30 minutes or more, the output level is converted into 70% at step S35. Then, at step S37, it is determined whether or not the elapsed time t2 of the current cooking has passed the current cooking period T set by the user.

In response to a result of determination at step S37, step S35 is repeated with the output level converted into 70% until t2 passes the current cooking period T, that is, until the current cooking operation is finished. If it is determined that t2 has passed the current cooking period T, the microwave oven is stopped at step S39.

Then, at step S41, T1 is set to T2 to accumulate periods of preceding cooking operations, and at step S43, timing of the pause duration td is started and continued until an operation command is input by the user.

That is, if td is 5 minutes or less, T1 for a subsequent cooking operation is set to T2(=T1+t2) to which only the preceding cooking period is added.

Meanwhile, next to step S45, the process progresses to step S47 wherein the microwave oven is operated at the output level of 70% after changing the magnetron output level to 70%. Then, at step S49, it is determined whether or not the elapsed time t2 of the current cooking has passed the current cooking period T set by the user.

In response to a result of determination at step S49, step S47 is repeated with the output level converted into 70% until t2 passes the current cooking period T, that is, until the current cooking operation is finished. If it is determined that t2 has passed the current cooking period T, the microwave oven is stopped at step S51.

Then, at step S53, T1 is set to T2 to accumulate periods of preceding cooking operations, and again at step S43, timing of the pause duration td is started and continued until an operation command is input by the user.

Meanwhile, as shown in FIG. 2*b*, if it is determined at step S61 that td is not in the range of 5<td≦15, the process progresses to step S135 shown in FIG. 2*c* to determine whether or not td is in the range of 15<td≦25.

On the other hand, if it is determined at step S61 that td is in the range of 5"<td≦15, t2 is initialized to 0 at step S63, and Z is set to Z+1 at step S65.

Then, at step S67, it is determined whether or not Z is 4 or more. If it is determined that Z is 4 or more, A is set to 0 at step S45. On the other hand, if it is determined that Z is less than 4, A is set to 5 minutes at step S69.

Then, at step S71, it is determined whether or not T1 is 10 or less. If it is determined that T1 is greater than 10, the process progresses to step S93 wherein it is determined whether T1 is in the range of 10<T1≦15. If it is determined that T1 is 10 or less, T2 is set to T1+t2+10 at step S73, and t2 is timed at step S75. Then, from steps S77 to S80, the microwave oven is operated at the preset output level for A minutes.

Here, at step S79, the microwave oven is operated at the preset output level for A minutes, and if it is determined that the elapsed time t2 of the current cooking has passed the current cooking period T set by the user, the process progresses to step S87 to stop the operation. At step S81, it is determined whether or not T2 is 30 minutes or more.

As a result of determination at step S81, if T2 is less than 30 minutes, the process returns to step S73, whereas, if T2 is 30 minutes or more, the output level is converted into 70% at step S83. Then, at step S85, it is determined whether or not the elapsed time t2 of the current cooking has passed the current cooking period T set by the user.

In response to a result of determination at step S85, step S83 is repeated with the output level converted into 70% until t2 passes the current cooking period T, that is, until the current cooking operation is finished. If it is determined that t2 has passed the current cooking period T, the microwave oven is stopped at step S87.

Then, T1 is set to t2 at step S89, and timing of the pause duration td is started and continued until an operation command is input by the user, at step S91.

Meanwhile, as a result of determination at step S93, if it T1 is not in the range of 10<td≦15, that is, if T1 is greater than 15, T2 is set to T1+t2 at step S115. On the other hand, if T1 is in the range of 10<td≦15, T2 is set to T1+t2+5 at step S95, and t2 is timed at step S97. Then, from steps S99 to S102, the microwave oven is operated at the preset output level for A minutes.

Here, at step S101, the microwave oven is operated at the preset output level for A minutes, and if it is determined that the elapsed time t2 of the current cooking has passed the current cooking period T set by the user, the process progresses to step S109 to stop the operation. At step S103, it is determined whether or not T2 is 30 minutes or more.

As a result of determination at step S103, if T2 is less than 30 minutes, the process returns to step S95, whereas, if T2 is 30 minutes or more, the output level is converted into 70% at step S105. Then, at step S107, it is determined whether or not the elapsed time t2 of the current cooking has passed the current cooking period T set by the user.

In response to a result of determination at step S107, step S105 is repeated with the output level converted into 70% until t2 passes the current cooking period T, that is, until the current cooking operation is finished. If it is determined that t2 has passed the current cooking period T, the microwave oven is stopped at step S109.

Then, T1 is set to t2 at step S111, and timing of the pause duration td is started and continued until an operation command is input by the user, at step S113.

Meanwhile, next to step S115, t2 is timed at step S117, and the microwave oven is operated at the preset output level for A minutes from steps S119 to S122.

At step S121, the microwave oven is operated at the preset output level for A minutes, and if it is determined that the elapsed time t2 of the current cooking has passed the current cooking period T set by the user, the process progresses to step S109 to stop the operation. At step S123, it is determined whether or not T2 is 30 minutes or more.

As a result of determination at step S123, if T2 is less than 30 minutes, the process returns to step S115, whereas, if T2 is 30 minutes or more, the output level is converted into 70% at step S125. Then, at step S127, it is determined whether or not the elapsed time t2 of the current cooking has passed the current cooking period T set by the user.

In response to a result of determination at step S127, step S125 is repeated with the output level converted into 70% until t2 passes the current cooking period T, that is, until the current cooking operation is finished. If it is determined that t2 has passed the current cooking period T, the microwave oven is stopped at step S129.

Then, T1 is set to t2 at step S131, and timing of the pause duration td is started and continued until an operation command is input by the user, at step S133.

Meanwhile, as shown in FIG. 2*c*, as a result of determination at step S135, if td is not in the range of 15<td≦25, t2 is initialized to 0 at step S165, whereas, if td is in the range of 15<td≦25, t2 is initialized to 0 at step S137 and Z is set to Z+1 at step S139.

Then, at step S141, it is determined whether or not Z is 4 or more. If it is determined that Z is 4 or more, A is set to 0 at step S45 shown in FIG. 2*a*, and if it is determined that Z is less than 4, A is set to 13 minutes at step S143.

Then, T2 is set to T1+t2 at step S145, and t2 is timed at step S147. Then, from steps S149 to S152, the microwave oven is operated at the preset output level for A minutes.

Here, at step S151, the microwave oven is operated at the preset output level for A minutes, and if it is determined that the elapsed time t2 of the current cooking has passed the current cooking period T set by the user, the process progresses to step S159 to stop the operation. At step S153, it is determined whether or not T2 is 30 minutes or more.

As a result of determination at step S153, if T2 is less than 30 minutes, the process returns to step S145, whereas, if T2 is 30 minutes or more, the output level is converted into 70% at step S125. Then, at step S157, it is determined whether or not the elapsed time t2 of the current cooking has passed the current cooking period T set by the user.

In response to a result of determination at step S157, step S155 is repeated with the output level converted into 70% until t2 passes the current cooking period T, that is, until the current cooking operation is finished. If it is determined that t2 has passed the current cooking period T, the microwave oven is stopped at step S159.

Then, T1 is set to t2 at step S161, and timing of the pause duration td is started and continued until an operation command is input by the user, at step S163.

Meanwhile, next to step S165, Z is set to 1 at step S167, and A is set to 0 minute at step S169.

Then, T2 is set to t2 at step S171, and t2 is timed at step S173. Next, the microwave oven is operated at the preset output level for A minutes from step S175 to step S178.

Here, at step S177, the microwave oven is operated at the preset output level set by the user for A minutes, and if it is determined that the elapsed time t2 of the current cooking has passed the current cooking period T set by the user, the process progresses to step S185 to stop the operation. At step S179, it is determined whether or not T2 is 25 minutes or more.

As a result of determination at step S179, if T2 is less than 25 minutes, the process returns to step S171, whereas, if T2 is 25 minutes or more, the output level is converted into 70% at step S181. Then, at step S183, it is determined whether or not the elapsed time t2 of the current cooking has passed the current cooking period T set by the user.

In response to a result of determination at step S183, step S181 is repeated with the output level converted into 70% until t2 passes the current cooking period T, that is, until the current cooking operation is finished. If it is determined that t2 has passed the current cooking period T, the microwave oven is stopped at step S185.

Then, T1 is set to t2 at step S187, and timing of the pause duration td is started and continued until an operation command is input by the user, at step S189.

As such, if the microwave oven is continuously operated within a pausing period of 5 minutes or less, it is possible to prevent overheating of the microwave oven by summing the preceding cooking periods and the current cooking period. If the pause duration is in the range of 5 to 15 minutes, T1 is divided into a cooking period of 10 minutes or less, a cooking period in the range of 10 minutes<T1<15 minutes and a cooking period of 15 minutes or more, and a weight value selected from +10, +5 and 0 is added to T1 corresponding to the conditions, thereby solving the problem related to continuous cooking operations of 3 times or more.

In particular, the reason of differently setting A to 13 minutes and 0 at steps S143 and S169 is that these pause durations are considered to be sufficient to cool the components of the microwave oven while preventing damage of the microwave oven. In addition, the reason of determining at step S179 whether or not T2 is 25 minutes or more is that A is zero which is different from the other conditions.

Meanwhile, it is desirable that the value of Z be set to 0 when the microcomputer is reset at an initial operation, that Z be increased one by one when the microwave oven is continuously used, and that Z be set to 1 when td is 25 minutes or more.

As apparent from the above description, in the method for preventing overheating of the microwave oven according to the invention, if the microwave oven is set to operate at a magnetron output level of predetermined value or less, it is operated at this output level, but if the microwave oven is set to operate at an output level exceeding predetermined, the magnetron is automatically changed in output level corresponding to a preceding cooking period and pause duration, so that components of the microwave oven are effectively prevented from being overheated while maintaining cooking efficiency even with a short cooking period of time.

It should be understood that the embodiments and the accompanying drawings have been described for illustrative purposes and the present invention is limited by the following claims. Further, those skilled in the art will appreciate that various modifications, additions and substitutions are allowed without departing from the scope and spirit of the invention as set forth in the accompanying claims.

What is claimed is:

1. A method for preventing overheating of a microwave oven including a controller for controlling a magnetron output level, comprising the steps of:

(a) receiving information of a cooking condition and a cooking start command for current cooking, the cooking condition comprising a magnetron output level and a current cooking period;

(b) confirming pause duration from when preceding cooking was finished to when the current cooking is started, if it is determined that the magnetron output level is a preset magnetron output level or more; and (c) determining a basic output period and a reference period for changing the magnetron output level corresponding to the confirmed pause duration, followed by operating the microwave oven at the preset magnetron output level after changing the magnetron output level to the preset magnetron output level, if it is determined that a driving period for changing the magnetron output level has passed the determined reference period for changing the magnetron output level, wherein the reference period for changing the magnetron output level is determined as a value obtained by summing a preceding cooking period, an elapsed time of the current cooking period and a time-dependent weight value.

2. The method according to claim 1, wherein at the step of (c), the microwave oven is operated at the magnetron output level input as the cooking condition during the basic output period.

3. The method according to claim 2, wherein the basic output period is differently set depending on the pause duration.

4. The method according to claim 1, wherein the basic output period is differently set depending on the pause duration.

5. The method according to claim 1, wherein the preceding cooking period is determined as a value obtained by summing all preceding cooking periods, of which range is determined depending on the pause duration.

6. The method according to claim 1, wherein the time-dependent weight value is determined depending on the pause duration.

7. A method for preventing overheating of a microwave oven including a controller for controlling a magnetron output level, comprising the steps of:

(a) receiving information of a cooking condition and a cooking start command for current cooking, the cooking condition comprising a magnetron output level and a current cooking period;

(b) confirming pause duration from when preceding cooking was finished to when the current cooking is started, if it is determined that the magnetron output level is a preset magnetron output level or more;

(c) increasing a counter value for changing the magnetron output level if the pause duration is a preset period or less, and initializing the counter value for changing the magnetron output level if the pause duration exceeds the preset period; and (d) operating the microwave oven at the preset magnetron output level after changing the magnetron output level to the preset magnetron output level if the counter value for changing the magnetron output level is a preset value or more, and determining a basic output period and a reference period for changing the magnetron output level corresponding to the confirmed pause duration if the counter value for changing the magnetron output level is less than the preset value, followed by operating the microwave oven at the preset magnetron output level after changing the magnetron output level to the preset magnetron output level if it is determined that a driving period for changing the magnetron output level has passed the determined reference period for changing the magnetron output level, wherein the reference period for changing the magnetron output level is determined as a value obtained by summing a preceding cooking period, an elapsed time of the current cooking period and a time-dependent weight value.

8. The method according to claim 7, wherein at the step of (d), the microwave oven is operated at the magnetron output level input as the cooking condition during the basic output period.

9. The method according to claim 8, wherein the basic output period is differently set depending on the pause duration.

10. The method according to claim 7, wherein the basic output period is differently set depending on the pause duration.

11. The method according to claim 7, wherein the preceding cooking period is determined as a value obtained by summing all preceding cooking periods, of which range is determined depending on the pause duration.

12. The method according to claim 7, wherein the time-dependent weight value is determined depending on the pause duration.

* * * * *